United States Patent [19]

Hokkeling et al.

[11] 4,208,607

[45] Jun. 17, 1980

[54] ELECTRIC LAMP WITH TIN OR LEAD ALLOY PLUG FOR LEAD-IN

[75] Inventors: Pieter Hokkeling; Roger J. Q. Van den Plas, both of Eindhoven, Netherlands

[73] Assignee: U.S. Philips Corporation, New York, N.Y.

[21] Appl. No.: 19,016

[22] Filed: Mar. 8, 1979

[30] Foreign Application Priority Data

Mar. 15, 1978 [NL] Netherlands ..... 7802796

[51] Int. Cl.[2] ..... H01J 5/50

[52] U.S. Cl. ..... 313/332; 313/331

[58] Field of Search ..... 313/331, 332

[56] References Cited

U.S. PATENT DOCUMENTS

| | | | |
|---|---|---|---|
| 3,448,322 | 6/1969 | Millikan et al. | 313/331 X |
| 4,015,165 | 2/1977 | Hardies | 313/331 X |

*Primary Examiner*—Alfred E. Smith
*Assistant Examiner*—Charles F. Roberts
*Attorney, Agent, or Firm*—Robert S. Smith

[57] ABSTRACT

The invention relates to an electric lamp having a pinch seal in which a molybdenum foil is incorporated as a current leadthrough conductor. An external current conductor is connected to the foil. As a result of differences in coefficients of expansion, a capillary space is present around the external current conductor, through which space oxidizing gas can reach the molybdenum foil. Oxidation of the foil involves an increase of its volume and results in crack of the pinch seal.

In lamps according to the invention a metal plug is provided around the external current conductor, said plug being sealed to said current conductor and to the glass of the pinch seal and sealing the capillary space in a vacuum-tight manner.

2 Claims, 3 Drawing Figures

ELECTRIC LAMP WITH TIN OR LEAD ALLOY PLUG FOR LEAD-IN

Figure 1:
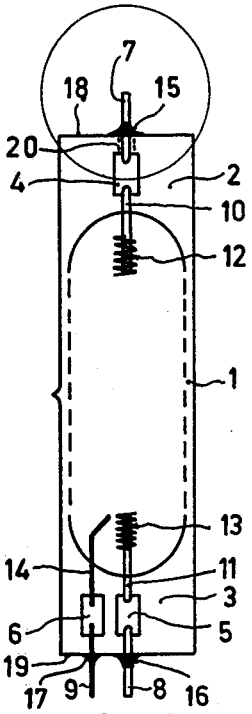

The invention relates to an electric lamp having a glass lamp envelope with a pinch seal, in which pinch seal at least one molydenum foil is incorporated. The foil is connected by an internal current conductor to an electric element accommodated inside the lamp envelope and an external current conductor emanating from the pinch seal, the external current conductor being surrounded by a metal plug which is sealed to said current conductor and is in contact with the glass of the pinch seal.

Such a lamp is disclosed in French Patent Application No. 7,504,825. In this lamp, the pinch is vacuum-tight between the ends of the molybdenum foil, this in spite of the differences in coefficients of thermal expansion between molybdenum and the type of glass used. It is possible because of the ductility of molybdenum and the shape of the foil. However, capillary spaces extend in the pinch along the current supply wires which are welded to the foil. These spaces have been formed in that after making the pinch the current supply wires, which usually consist of molybdenum or tungsten, have shrunk, upon cooling to room temperature, to a greater extent than the surrounding glass which is a hard glass i.e. a glass having a silicon oxide content of at least 95% by weight. Such types of glass having a high silicon oxide content are most frequently used and also have a coefficient of thermal expansion which differs considerably from molybdenum and tungsten (approximately $10\times10^{-7}$°C$^{-1}$ as against approximately $45\times10^{-7}$ and $54\times10^{-7}$°C$^{-1}$, for W and Mo).

The surrounding atmosphere can penetrate to and oxidize the molybdenum foil via the capillary space around the external current conductor. As a result of this the volume of the foil increases, which results in cracking and loss of vacuum-tightness of the pinch. As a result of this, lamps reach their end of life long before the calculated life has been reached.

In lamps according to the above French Patent Application, oxidation of the molybdenum foil is mitigated in that around the external current conductor, in a place which is situated in the pinch, a copper plug has been provided which impedes the diffusion of oxidizers through the capillary space to the molybdenum foil, but which—as stated in the application itself—produces no vacuum-tight connection with the glass and hence no vacuum-tight seal of the capillary space.

It is the object of the invention to provide lamps in which the capillary around the external current conductor is sealed in a vacuum-tight manner.

According to the invention, this object is achieved in lamps of the kind mentioned in the preamble in that the metal plug consists of at least a first metal selected from the group consisting of tin and lead, mixed with at least a second metal selected from the group consisting of titanium, zirconium, hafnium, niobium, tantalum and vanadium, the weight ratio first-metal: second-metal being 100:0.05 to 100:1, the plug being also sealed to the glass of the pinch seal.

Lamps according to the invention are excellently protected against oxidation of the molybdenum foil, as has been found in experiments in which the lamps were stored for 5 months according to the I.E.C. 68 D4 standard in a "tropical cupboard".

Experiments have demonstrated that a metal plug of the above composition still seals the capillary space around a current conductor in a quartz glass pinch in a vacuum-tight manner after having been subjected to temperatures reaching up to 350° C. This is remarkable since the metal, when tin is used as the first metal, melts at approximately 235° C. Apparently, the metal adheres excellently to glass.

Since it is a requirement in many cases that the pinch of a lamp during operation should not exceed a temperature of 350° C., the test was restricted to this temperature. It may be assumed that, certainly when lead is used as the first metal, in which case the melting-point is approximately 330° C., the metal plus will still present a good protection against oxidation at even higher temperatures.

Although according to the above-mentioned French Patent Application the metal plug is situated in the pinch, it is to be preferred in lamps according to the invention to position the plug on the end face of the pinch, that is to say on that face of the pinch from which the external current conductor emanates. This has for its advantage that the lamps can be made in a better reproducible manner. Upon making the pinch the temperature is very much higher than the melting-point of the sealing metal. In the lamp according to the French Patent Application the metal can easily flow too strongly under the influence of the pressure exerted during pinching. When positioning the plug on the end face of the pinch, the ductility which the first metal gives to the plug is also maximally used to advantage so that differences in shrinkage and expansion of metal and glass are readily compensated for.

In an embodiment the weight ratio first metal: second metal in the metal plug is 100:0.5 to 100:1. The properties of the components of the plug: ductility of the first metal and adhesion of the second metal, are then used optimally.

The metal plug may be made by providing the sealing metal, for example in the form of a wire, around the external current conductor on the end face of the pinch and heating in a neutral or reducing atmosphere to approximately 1000° C. The plug is formed in some ten seconds.

If a lamp according to the invention is exposed to high temperatures in an oxidizing atmosphere, an oxide skin will be formed on the metal plug which will prevent further progress of oxidation of the plug.

It is to be noted that a water-cooled discharge lamp is disclosed in German Patent Specification No. 683,381 in which a metal cap is provided over the pinch so as to prevent electrolytic attack of the external current conductors. The cavity bounded by the cap is filled with lead. Adhesion of the lead to the quartz glass of the lamp envelope, however, is not obtained since the pinch of the lamp envelope is profiled so as to produce a good connection of the cap and since it is recommended to seal the gap between the cap and the lamp envelope with suitable material so as to exclude contact of the cooling liquid with the external current conductor.

It is furthermore to be noted that a soldered joint between quartz glass and molybdenum, tungsten or tantalum is known from British Pat. No. 1,103,056. The soldered joint consists of 2 to 3% by weight of titanium and 98 to 97% by weight of tin. In the joint described in said Patent Specification, a quartz glass disk is surrounded by a molybdenum ring and is connected thereto in a vacuum of approx. 1,000° C. with the interposition of solder. Since molybdenum has a very much higher coefficient of expansion than quartz glass, the solder after cooling is under a compressive stress.

Experiments have confirmed that this soldered joint is vacuum-tight. However, if it is tried in an identical manner and with the same solder to make a joint in which quartz glass surrounds molybdenum, it is found that the joint is not vacuum-tight at all. In this case tensile stresses are formed in the solder upon cooling, as a result of the larger shrinkage of molybdenum. Apparently, the solder does not present sufficient resistance thereto. In lamps according to the invention, the soldered joint is also under a tensile stress. Surprisingly, when solder having a smaller titanium contact is used, a vacuum-tight soldered joint is obtained indeed.

The lamps according to the invention may be discharge lamps, in which case the electric element accommodated inside the lamp envelope is an electrode pair. The lamps are suitable in particular for use without an outer envelope. The electric element may, however, alternatively be a filament. The invention is of importance notably for lamps which have a long calculated life, for example floodlight lamps and heat radiators, whether or not with a regenerative gas atmosphere.

Figure 2:
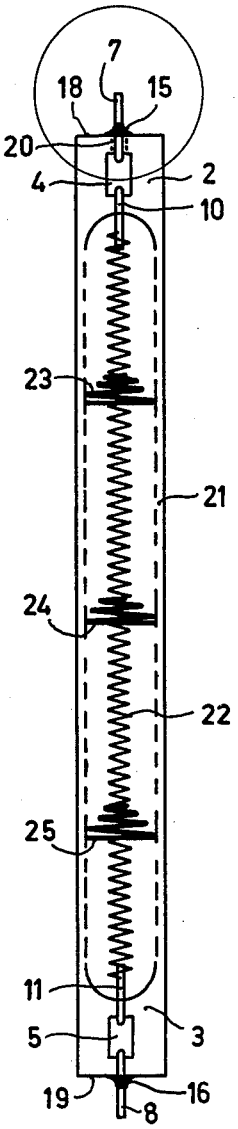
Figure 3:
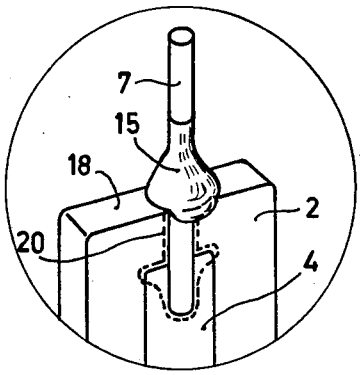

Embodiments of the invention will now be described in greater detail with reference to the figures and the example, in which FIG. 1 is an elevation of a high-pressure mercury vapour discharge lamp, FIG. 2 is an elevation of an incandescent lamp, and FIG. 3 is a perspective view of a detail of FIGS. 1 and 2.

In FIG. 1, 1 denotes the lamp envelope of a high-pressure mercury vapor discharge lamp having pinch seals 2 and 3 in which molybdenum foils 4 and 5, 6 respectively, are accommodated. External current conductors 7, 8 and 9, respectively, are welded to said foils. The internal current conductors 10 lead to the pair of electrodes 12, 13. An ignition electrode 14 is connected to the foil 6. Metal plugs 15, 16 and 17, respectively, are provided around the external current conductors 7, 8 and 9 on the end faces 18 and 19, respectively, of the pinch seals 2 and 3, respectively. The capillary duct around the external current conductor 7 is denoted by 20.

In FIGS. 2 and 3, the same reference numerals are used for corresponding components. In FIG. 2, 21 denotes the lamp envelope of an incandescent lamp having a filament 22 which is supported by the supporting members 23, 24 and 25.

EXAMPLE

In a practical case the quartz glass lamp envelope of an incandescent lamp had an inside diameter of 7.1 mm and an inside length of 142 mm. A tungsten filament was stretched axially in the lamp envelope. The limbs of the filament were each welded to a molybdenum foil incorporated in the pinch seals to which external conductors of molybdenum (0.6 mm diameter) were also welded. The lamp envelope was filled with 2.5 bar argon to which 0.2% by volume of $CH_2Br_2$ had been added. During operation the lamp consumed a power of 1000 W at 220–230 V.

A metal plug consisting of tin and 1% by weight of titanium was fused to the end faces of the pinch seals and to the external current conductors. The metal plug protected the molybdenum foil up to the lamp's rated life.

Such lamps were also made using a plug of lead to which 0.05% by weight and 0.1% by weight, respectively, of titanium had been added. The pinch seal was heated at 1,000° C. in $N_2/H_2$ (92/8 vol/vol) as a protective gas upon providing the plug. A vacuum-tight connection was obtained in all cases.

What is claimed is:

1. An electric lamp having a glass lamp envelope with a pinch seal in which pinch seal at least one molybdenum foil is incorporated to which are connected an internal current conductor to an electric element accommodated inside the lamp envelope and an external current conductor projecting from the lamp envelope, the external current conductor being surrounded by a metal plug which is sealed to said current conductor and is in contact with the glass of the pinch seal, characterized in that the metal plug consists of at least a first metal selected from the group consisting of tin and lead mixed with at least a second metal selected from the group consisting of titanium, zirconium, hafnium, niobium, tantalum and vanadium, the weight ratio first-metal; second-metal being 100:0.05 to 100:1, the plug being also sealed to the glass of the pinch seal.

2. An electric lamp as claimed in claim 1, characterized in that the first metal in the plug is lead.

* * * * *